United States Patent [19]

Lichter

[11] Patent Number: 4,850,287

[45] Date of Patent: Jul. 25, 1989

[54] SAFE WITH DOUBLE SLIDING DOOR

[76] Inventor: Robert J. Lichter, 15571 Placid Cir., Huntington Beach, Calif. 92647

[21] Appl. No.: 160,868

[22] Filed: Feb. 26, 1988

[51] Int. Cl.[4] ..... E05G 1/04; E06B 7/00

[52] U.S. Cl. ..... 109/59 R; 109/67; 109/70; 49/464

[58] Field of Search ..... 109/59 R, 59 T, 67, 109/69, 70, 73, 74, 75; 49/128-130, 368, 370, 464

[56] References Cited

U.S. PATENT DOCUMENTS

| | | | |
|---|---|---|---|
| 67,045 | 7/1867 | Hall . | |
| 1,342,482 | 6/1920 | Wexler | 49/370 |
| 1,623,255 | 4/1927 | Le Compte et al. | 109/67 |
| 3,481,288 | 12/1969 | Teleky | 109/58 |
| 3,715,998 | 2/1973 | Teleky | 109/58 |
| 3,842,761 | 10/1974 | Bloom | 109/59 |
| 3,904,064 | 9/1975 | Looker | 49/464 |
| 4,070,074 | 1/1978 | Rohme | 312/245 |
| 4,136,792 | 1/1979 | Wilson | 214/145 A |
| 4,145,978 | 3/1979 | Johnson et al. | 109/59 R |
| 4,176,440 | 12/1979 | Lichter | 29/458 |
| 4,294,040 | 10/1981 | Crotti | 49/254 |
| 4,294,049 | 10/1981 | Young et al. | 49/464 |
| 4,712,490 | 12/1987 | Lichter | 109/69 |

*Primary Examiner*—Neill R. Wilson

*Attorney, Agent, or Firm*—Gausewitz, Carr & Rothenberg

[57] ABSTRACT

A safe having a valuables receiving chamber with a generally rectangular access opening with a first ledge arrangement for placement of two plate-shaped separable steel doors thereagainst, with first and second grooves formed on the opposite walls transverse to the first set of opposing walls. A second ledge arrangement is placed in parallel relation to the first for enabling slidable receipt of one door member therein, with the second ledge arrangement being dimensioned so that the ends thereof, along with the grooves retain both the first door member and a second door member. The width of the grooves and the distance between the two sets of ledges are of a dimension slightly more than the thickness of the door, with one of the grooves having a depth substantially greater than the other. A first door is dimensioned to occupy less than one-half the access opening, and the second door is dimensioned to occupy the majority of the remaining area. The second set of ledges, along with the grooves are dimensioned, arranged and configured for enabling captive retention of both doors, while enabling selective removal of the second door, or both doors if desired. Strap members are attached on opposite surfaces of the doors at the edges of contact for deterring intrusion.

36 Claims, 3 Drawing Sheets

SAFE WITH DOUBLE SLIDING DOOR

CROSS-REFERENCE TO RELATED APPLICATION

The subject matter of this application is related to the subject matter of applicant's copending patent application filed concurrently herewith entitled "Sliding Door Safe with Anti-Intrusion Device", such patent application bearing Ser. No. 07/160,817, and filing date of Feb. 26, 1988.

BACKGROUND OF THE INVENTION

The background of the invention will be discussed in two parts:

Field of the Invention

This invention relates to the field of safes adapted to contain valuable papers and articles.

Description of the Prior Art

There are numerous prior art wall and floor safes adapted to be embedded in concrete, etc. or adapted to be free-standing. The variations, and complexities in such safe structures have a direct impact on the cost of construction, and ultimately, the cost of such safes. Many of such safes are intended for residential use, and may be installed in a wall or in a floor of the residence, and, in the latter instance such safes are normally embedded in concrete.

A safe with a sliding door structure is shown and described in U.S. Pat. No. 4,712,490, issued to the inventor on Dec. 15, 1987, which patent is entitled "Safe", which discloses a separable sliding safe door structure with a lock mechanism in which the lock bolt is placed in shear to deter entry.

An early safe structure is shown and described in U.S. Pat. No. 67,045 issued July 23, 1867, to Hall for a "Burglar-Proof Safe" in which a stepped laminated door structure fits within a correspondingly formed door opening.

Another safe structure is shown and described in U.S. Pat. No. 3,481,288, entitled "Wall Safe", issued to Teleky on Dec. 2, 1969, the safe including a permanently installed container with lateral vertically arranged recesses configured for receiving a separate door portion by lateral insertion into the recesses.

U.S. Pat. No. 3,715,998, is directed to another such safe structure, and is entitled "Wall Safe", such patent being issued to Teleky on Feb. 13, 1973, the structure having a door which is substantially rectangular and when it is in the closed position the margins of the door substantially throughout their entire length are overlapped by recesses along the margins of the opening that is closed by the door.

U.S. Pat. No. 4,070,074, entitled "Tamper-Proof Cabinet", issued to Rohme, on Jan. 24, 1978, such patent disclosing a cabinet having a door which is required to be unlatched by an initial unlatching sliding movement and then the usual pivotal traverse from its closed into its open position.

Another safe structure is shown and described in U.S. Pat. No. 4,176,440, issued to Robert J. Lichter, the applicant herein, on Dec. 4, 1979, such patent being entitled "Safe, and Method and Apparatus for Building It", the safe being a "do it yourself" safe, wherein the parts are assembled in an appropriate location within the residence, and then the concrete is poured, and the balance of the parts attached.

A building door is shown and described in U.S. Pat. No. 4,294,040, entitled "Safety Door for Buildings and Rooms", issued Jan. 8, 1957, to Crotti, the patent disclosing a safety door structure which is transversely sliding with one part thereof serving as a supporting column equipped with hinges and the other serving as a door panel rotatably supported by the hinges, the supporting column disappearing from view during the opening stage with the opposite side of the door, including the lock, disappearing from view upon closing with the lock accessible through an access opening.

With conventional safe doors, the majority of such doors include spring and hinge mechanisms, which intrude into the access opening, and thereby limit the area of the opening for a valuables chamber of given dimensions. A separable sliding door construction, such as in Applicant's above mentioned U.S. Pat. No. 4,712,490, permits a greater access opening for a valuables chamber of a given dimension. However, with a separable door structure, as the dimension of the valuables chamber increases, the dimension of the access opening, and hence the door size, also increases.

In accordance with an aspect of the invention, it is an object to provide a new and improved safe and door structure in which the door is formed of two separable parts.

SUMMARY OF THE INVENTION

The foregoing and other objects are accomplished by providing a safe having a valuables receiving chamber with a generally rectangular access opening with a first set of inwardly extending ledges on opposing walls for placement of a plate-shaped separable steel two door arrangement thereagainst, and first and second grooves formed on the opposite walls transverse to the first set of opposing walls. A second set of ledges are placed in parallel relation to the first set of ledges for enabling slidable receipt of one door member therein, with the second set of ledges being dimensioned so that the ends thereof, along with the grooves retain both the first door member and a second door member. The width of the grooves and the distance between the two sets of ledges are of a dimension slightly more than the thickness of the door. One of the grooves has a depth substantially greater than the other. The door arrangement includes two plate shaped, generally rectangular steel door members, a first of which is dimensioned to occupy more than one-half the access opening, and the second of which is dimensioned to occupy the remaining area. Each bar of the second set of ledges extends slightly beyond the width of the one door member, with the extensions serving to engage the upper surface of one edge of the other door member at the corners thereof. The second door member is configured for enabling one edge of the door to be inserted on a slight angle into the space between the extension while the other edge is pivoted toward the ledge, the second door then being laterally displaced along with the first door until the latter edge of the second door is in abutment with the seat of the shallower groove. A lock assembly on the reverse side of the first door has the latch bolt engaging a detent in one bar of the lower ledges for prevention of lateral movement. Strap members are attached on opposites sides of the doors at the edge of contact for deterring intrusion.

Other objects, features and advantages of the invention will become apparent from a reading of the specifications, when taken in conjunction with the drawings, in which like reference numerals refer to like elements in the several views.

DESCRIPTION OF THE PREFERRED EMBODIMENT

Figure 1:
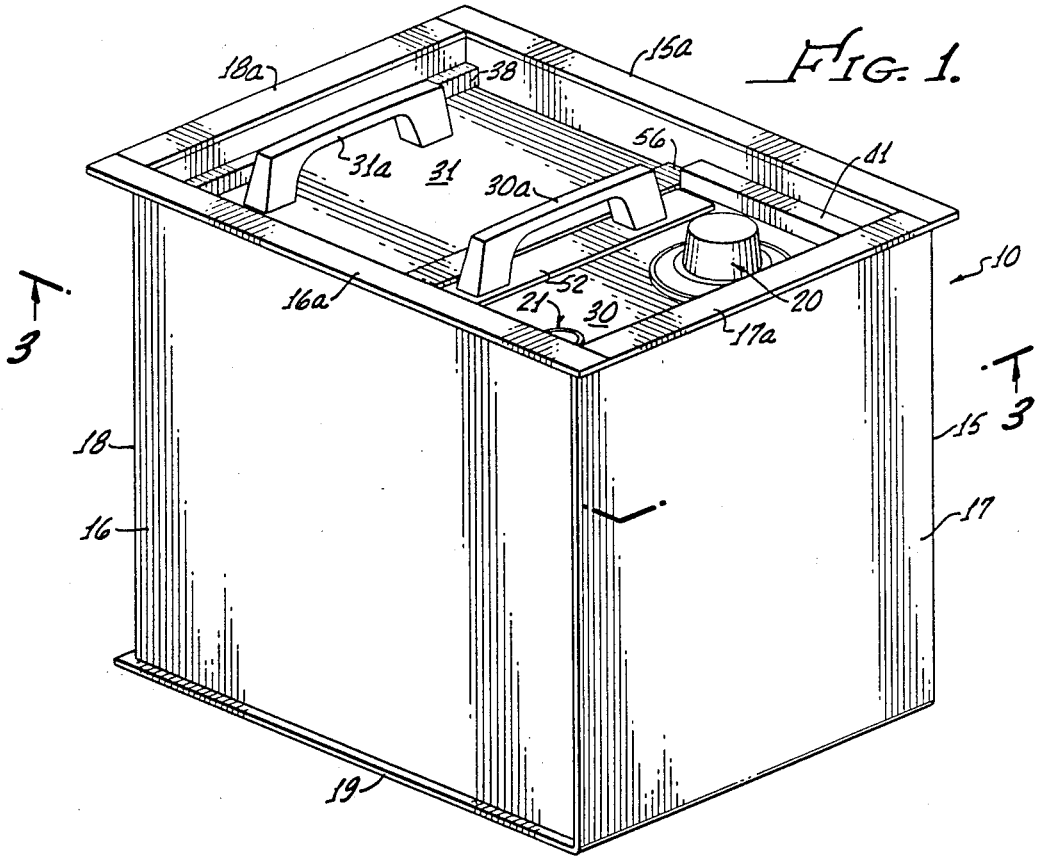
FIG. 1 is a perspective view of the double sliding door safe apparatus in accordance with the present invention.
Figure 2:
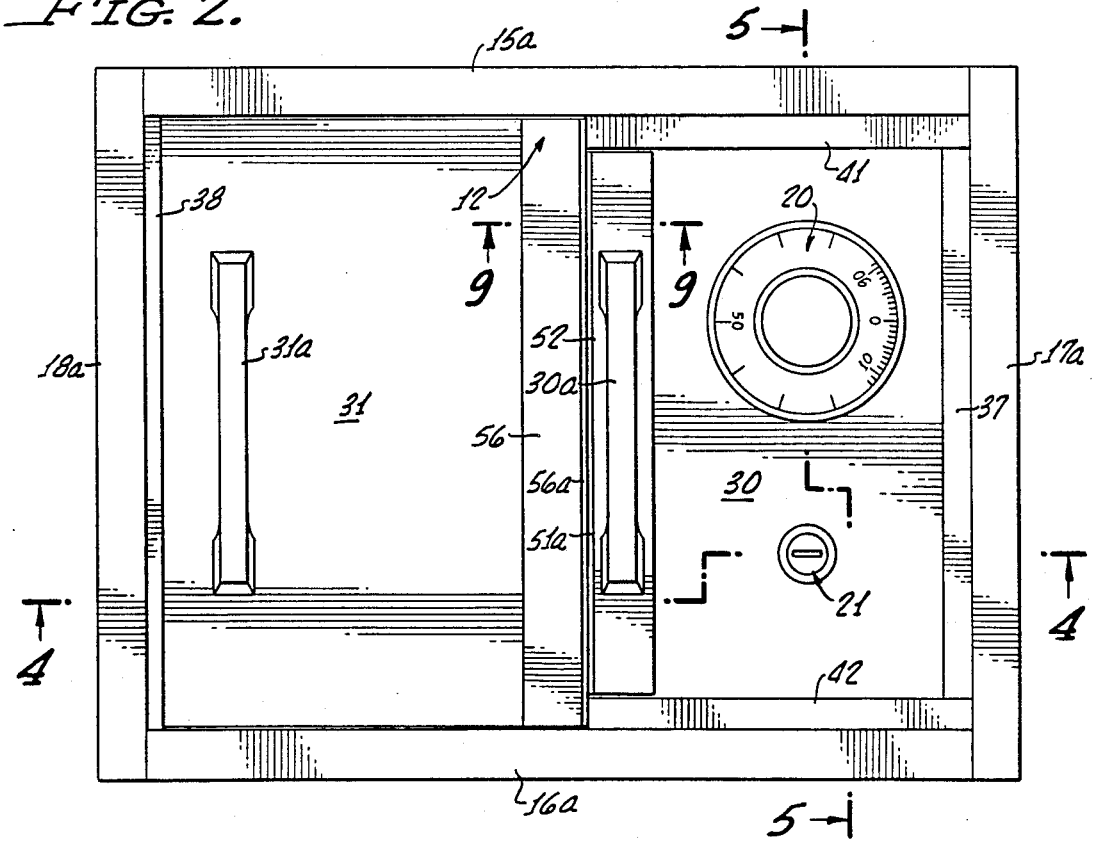
FIG. 2 is a top plan view of the double sliding door safe apparatus of FIG. 1.
Figure 3:
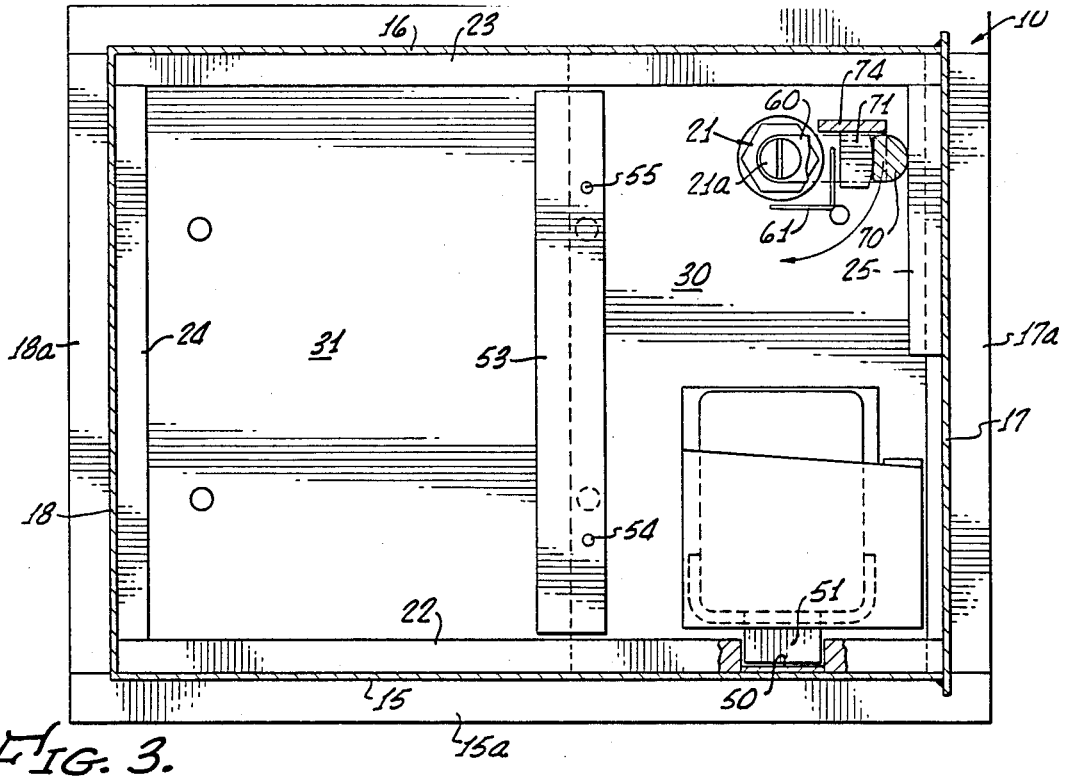
FIG. 3 is cross-sectional view, partially broken away, of the safe apparatus of FIG. 1 as viewed generally along line 3—3 thereof, to show details of the underside of the sliding double door arrangement with the door in the locked position and the locking mechanism in the locked position.

Referring now to the drawings, and particularly to FIGS. 1 through 3, there is shown a safe, generally designated 10, having a somewhat elongate generally rectangular (in plan view) enclosure forming a valuables receiving chamber 12, accessible through an access opening 14. The safe includes a door arrangement of first and second doors 30 and 31, for closing the chamber 12, with one of the doors 30 including a combination lock mechanism 20 and an accessory key lock mechanism 21. To facilitate removal and insertion, as will be described hereafter, door handles **30*a* and 31*a* are provided on doors 30 and 31**.

The enclosure is formed of first and second opposing side walls 15 and 16, an interconnecting set of mutually perpendicular third and fourth opposing end walls 17 and 18, and a bottom 19. Such an enclosure may be fabricated from sheet metal or sheet steel of sufficient thickness suitably connected such as by bending and welding. It is also to be understood that the invention described herein is equally applicable to a safe which is formed of all metal, such as by steel fabrication or steel casting methods, or may be used in the cast in place concrete safe construction of Applicant's U.S. Pat. No. 4,176,440. The walls 15–18 and bottom 19, in the embodiment to be described are formed of steel plate stock which is bent and suitably welded together.

The upper edges of the walls 15–18 define a common plane. Straps of steel **15*a*–18*a* are secured, such as by welding, to the upper edges of the walls 15–18 to form an outer protruding peripheral flange portion which assists in assembly of the safe 10 within a floor or wall. Spaced downwardly from this common plane, and extending inwardly from the side walls 15 and 16 and end walls 17 and 18, are a first set of laterally extending door receiving ledges 22–25 (See FIG. 3), with ledges 22 and 23 both at a predetermined distance from, and parallel to, this common plane. The ledges 22, 23 may be formed of bar stock metal suitably welded to the interior surfaces of the side walls 15 and 16**.

As shown in FIG. 3, another ledge 24 is formed by a bar member secured to the end wall 18 and extending between the ledges 22 and 23, with the upper surfaces coplanar. Another shorter ledge 25 is formed on the opposite end wall 17, such as by welding a bar member to the interior of the end wall 17, with one edge of the bar member in abutting relation with a side of the ledge 23. While the ledge 25 may traverse the width between ledges 22 and 23, a portion has been removed to provide clearance for the combination lock mechanism. The upper edges of the ledges 22 through 25 define a plane which supports the doors 30, 31. The ledges 22–25 generally define the access opening 14.

The door arrangement includes first and second generally rectangular plate-shaped steel doors 30, 31, the overall dimension of the two doors, when placed side by side in edge abutting relation, being of a dimension to substantially close the upper opening of the safe 10. By reference to FIGS. 3 and 7, the doors 30, 31 are shown in side elevation between end walls 17, 18, resting on the ledges 22–25, with door 30 being shorter than door 31, and, with the two doors placed in edge abutting relation, the overall dimension is a predetermined dimension less than the dimension between end walls 17, 18.

The end walls 17 and 18 have first and second groove means formed between the corresponding ledge and an upper bar member, with the thickness of the groove being slightly greater than the thickness of the coacting edge of the plate material for the doors 30, 31. As shown in FIGS. 4, 5, 7 and 8, these opposing laterally extending first and second grooves 32 and 34, are each at the same distance from, and generally parallel to, the upper edges of the walls 17 and 18. The groove 32 is formed by an upper bar member 37 secured to the interior of the end wall 17, such as by welding, with bar member 37 in spaced relation to the ledge 25, the spacing forming a door edge receiving groove 32 of a width slightly greater than the thickness of the coacting edge of the door 30. Similarly, the opposing groove 34 is formed by another upper bar member 38 secured to the interior of the end wall 17, such as by welding, with bar member 38 in spaced relation to the ledge 24, the spacing forming a door edge receiving groove of a width slightly greater than the thickness of the coacting edge of the second door 31. With the coacting edges of both doors of generally equal dimension, the groove spacing between each bar and its corresponding ledge (which form grooves 32 and 34) is the same.

Figure 4:
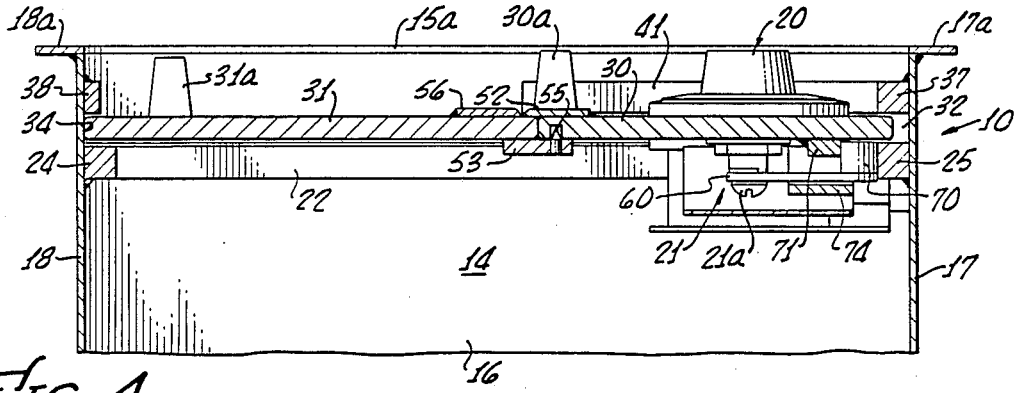
FIG. 4 is a side cross-sectional view of the door arrangement of the safe apparatus of FIG. 2, as viewed generally along line 4—4 thereof.

As can be seen, the inwardly protruding dimension of bar member 37 is about twice that of the inwardly protruding dimension of bar member 38, thus resulting in groove 32 having an insertion depth (the distance from the innermost edge to the groove seat defined by the end wall) of about twice that of groove 34. FIG. 4 depicts the doors 30, 31 in edge abutting relation slid to the left, as viewed therein, with the edge of door 31 bottomed within the seat of groove 34. As can be seen, there is a space of a predetermined dimension between the rightmost edge of door 30 and the bottom of the groove 32, with this dimension being slightly greater than the dimension of the inward protrusion of bar member 38.

By referring to FIG. 2, above door 30, there is a second ledge, formed from lateral bar members 41 and 42, which are secured to the side walls 15 and 16, respectively. Bar members 41 and 42 form outer stop members for the side edges of door 30, along with the bar member 37. In addition, bar members 41 and 42, along with ledges 22 and 23 therebelow, define slide rails, for insertion of the door 30 therebetween. As shown in FIG. 4, with the doors 30 and 31 moved to the left (the locked position), the bar members 41, 42 have a dimension in the direction of sliding, which is longer than a dimension equal to the width of the door 30 in the same direction plus the predetermined dimension of the space to the right of the edge of door 30.

Figure 6:
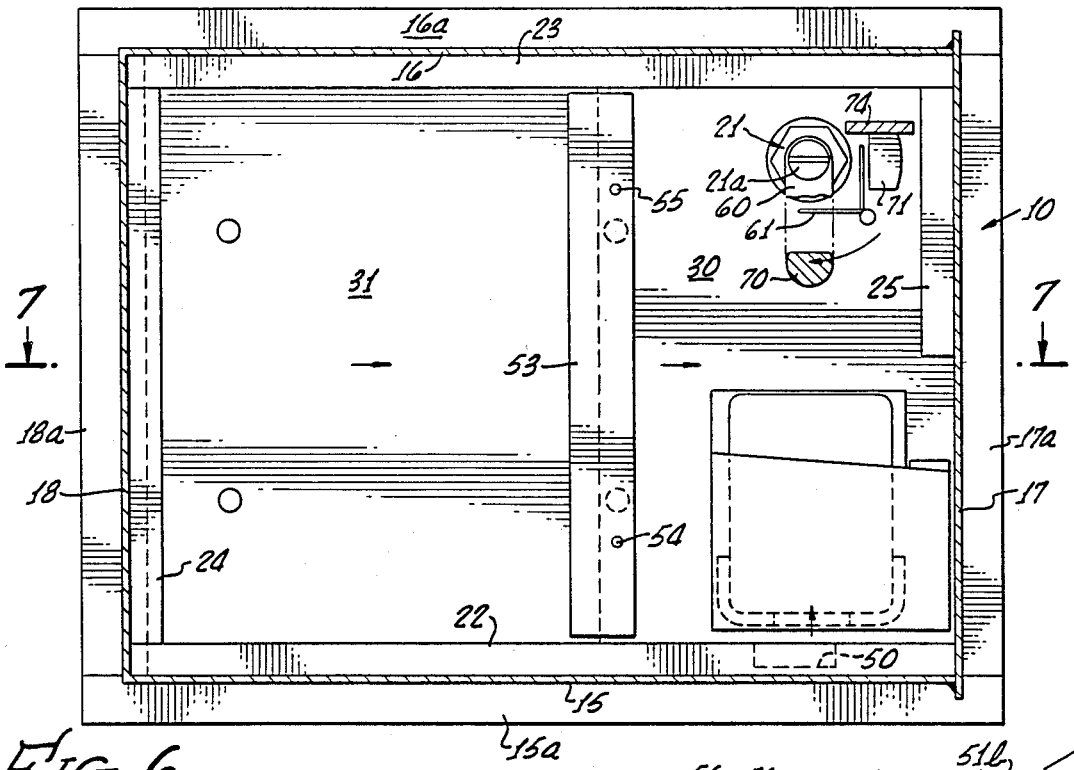
FIG. 6 is a bottom plan view of the door arrangement of the safe apparatus similar to the view of FIG. 3, with the locking mechanisms unlocked, and the doors slid to a side in preparation for removal.

As shown in FIGS. 3 and 6, the bar 22 of the first ledge means is provided with an indentation which forms a lockbolt receiving notch 50 disposed in general alignment with the location of a lockbolt 51 of the lockset 20, which includes a combination dial accessible from the exterior of the door 30. The lockset 20 is secured to the bottom or interior of the door 30, such as by bolts, with the lockbolt 51 being slidable, that is, movable from a position within the housing of the lockset 20 to an extended position, shown in FIG. 3 into engagement with the notch 50.

As shown in FIG. 1, the doors 30 and 31 preferably each include a handle **30*a*, 31*a*, secured to the exterior of the respective door members 30, 31, for facilitating lifting and removal of the door 30. The handles 30*a* and 31*a* are secured with fasteners in such a way that excessive force, such as by applying a lever to force either door 30, 31, will result in breakage of the fasteners. As shown in FIGS. 1 and 2, the door 30 includes a strap member 52 secured to the outer or upper surface thereof, such as by welding, with the strap member 52 having a length slightly less than the distance between the upper ledge members 41, 42. Referring also to FIGS. 3 and 4, the strap member 52 is mounted to door 30, such as by welding along edge 52*b*, so that the strap member 52 overlaps the edge of the door 30 along the edge which is to be placed in edge abutting relation with the second door 31. In this manner, with the doors 30 and 31 in the locked position shown in FIG. 4, the junction of the two doors is concealed by the strap member 52, thus deterring the insertion of a prying tool into the space at this junction. The handle 30*a* of the first door 30 is assembled through this strap member 52**.

As a further deterrent, as shown in FIGS. 3, 4, and 6 through 8, the inner or underside of the adjacent coacting edge of the second door 31 has a second strap member 53 secured thereto in overlapping relation to the edge at the junction. The second strap member 53 is provided with alignment means, such as spaced apart tapered alignment pins 54, 55, configured for mating coacting engagement with alignment holes, only one hole 57 being shown, which holes are formed in the inner or undersurface of the first door 30. The second strap member 53 and alignment means serve a dual function. Initially they serve to maintain the two doors in edge abutting relation during sliding on the first ledge means. In addition, should an intruder be successful in prying off the first strap member 52, the second strap member 53 and alignment means continue to hold the two doors 30, 31, together to deter insertion of a pry bar at the junction.

Figure 9:
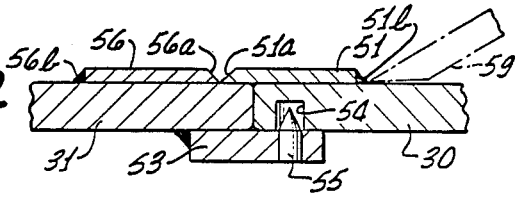
FIG. 9 is an enlarged fragmentary cross-sectional view of the juncture of the two doors in the safe apparatus of FIG. 2 as viewed generally along line 9—9 thereof.

To further secure the junction of the two doors 30 and 31, by reference also to FIG. 9, a third strap member 56 is secured to the upper or outer surface of the edge of the door 31, this strap member 56 being secured, such as by beveled bead welding along edge **56*b* thereof. The strap member 56 is of a narrower width than the strap member 52 (See FIGS. 2 and 4), and positioned for edge abutting relation therewith, with the doors 30 and 31 in edge abutting relation. The length of strap member 56 is sufficient to span the distance between side walls 15 and 16, and thus, also at least partially conceal the lower edges of the opposing partial bar members 41, 42**.

The edges of contact, that is edge **52*a* of strap member 52, and edge 56*a* of strap member 56, are beveled as shown in enlarged view in FIG. 9. With the welded edges 52*b* and 56*b* likewise forming somewhat of a bevel, forcible entry is deterred. Should an intruder attempt to use a chisel, the end 59 of which is shown in dotted lines, to attempt to remove either of the strap members 52 and 56, the force of the chisel 59 would be lateral, that is parallel to the outer surface of the door 30. The beveled weld bead 52*b* would act as a ramp directing or deflecting the pointed end of the chisel 59 upwardly. The same would be true if the chisel 59 were to be directed at the beveled weld bead 56*b*. With respect to the V-shaped joint at the abutting beveled edges 52*a* and 56*a*, if an intruder attempted to insert a pry bar within this groove, there is no edge for frictional engagement by a pry bar, and correspondingly intrusion attempts are deterred. Similarly, if an intruder attempted to use a chisel in this V-shaped groove, a downward force on the chisel would result on impact against the surface of the door 31 beneath the junction of edges 52*a* and 56*a*, and would not assist in forcible entry to the space between the junction of the abutting edges of doors 30 and 31 concealed beneath strap member 52**.

Referring now to FIGS. 3 through 8, the relationship of the door arrangement to the first set of ledges 22–25 and the second set of ledges 41, 42, as well as the grooves 32, 34, will be described. The combined area of the doors 30, 31 are dimensioned for being received in and completely removed from the access opening 12 of the chamber 14. For this purpose, the first door member 30 is generally rectangularly configured, or square, in plan elevation with the width thereof closely approximating the width of the chamber 14. The length of door member 30, that is, in the direction between end walls 17 and 18, is a dimension which is less than one-half the dimension between end walls 17 and 18. The width of the second door member 31 is generally identical to the width of the first door member 30, with a length of a dimension less than the difference between the dimension between end walls and the dimension of the door 30 in the direction between end walls 17 and 18. This difference is combined length of the doors 30, 31 and the dimension between end walls 17, 18, is a predetermined dimension which is approximately the inwardly extending dimension of the bar 38, which defines the upper part of groove 34.

Figure 7:
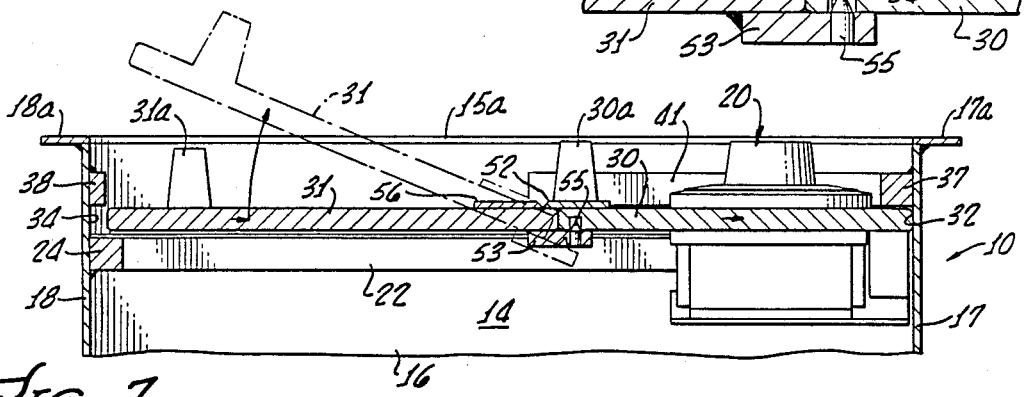
FIG. 7 is a side cross-sectional view showing the door arrangement in the position of FIG. 6, as viewed generally along line 6—6 thereof, with a broken line depiction of one door member positioned for removal or insertion.
Figure 8:
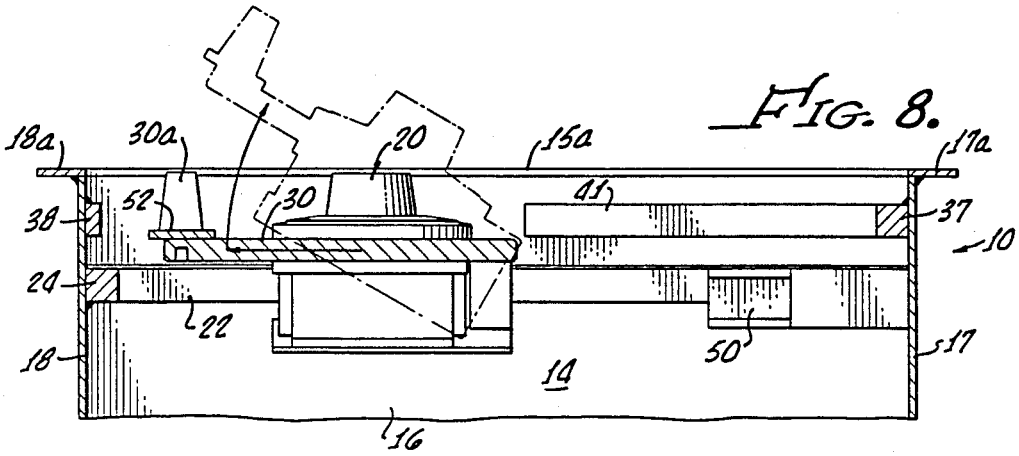
FIG. 8 is a side cross-sectional view similar to FIG. 6, with the other door member shown in solid lines and broken lines as positioned for removal or insertion.

By specific reference to FIGS. 4 and 7, FIG. 4 shows both doors 30, 31, in position on ledges 22–25, with the combined door arrangement slid to the left, as viewed in the drawings, to the locked position, that is, with lockbolt 51 in engagement within notch 50 of bar 23. At the right side thereof, there is a gap of predetermined dimension, the dimension of this gap being slightly more then the width of the bar 38 on the opposite upper side of the door arrangement, FIG. 7 shows, in solid lines, the doors 30 and 31 in edge abutting relation, slid to the right, as viewed in the drawings, in a position preparatory to insertion or removal of the doors 30, 31.

As will become apparent, the two door arrangement of doors 30 and 31 enables removal of one door 31 only, if desired, with removal of this one door 31 providing a large portion of access through the access opening 12. Furthermore, with the one or both lock assemblies 20, 21, attached to door 30, the weight of door 31 is less due to the absence of locking hardware. In actual practice, it is seldom necessary to remove door 30.

The combined length of the doors 30, 31, when placed on the ledges 22–25, relative to the length between end walls 17, 18, and further relative to the upper ledge bars 41, 42, provides the following result. For insertion, the first door 30 is held by the handle 31*a* and is placed on ledges 22, 23, and slid to the right as viewed in FIG. 7, sliding in the slide rails formed between lower ledges 22–25 and upper ledge bars 41, 42. The second door 31 is inserted at an angle as shown in broken lines 31′ in FIG. 7, with the door 31 having slightly rounded lower corners (not shown) at the point of contact with the ledges 22, 23. At this point, the strap member 53 is at an angle along with the door 31, with the alignment pins 54, 55 dimensioned in height so as not to interfere. As the door 31 is pivoted downwardly to the solid line position, with the coacting edges held in abutting relation, the pins 54, 55, pivot upwardly into the alignment holes 58. The door 31 is being lowered along the opposite edge until this opposite edge clears the upper edge of bar 38, forming the upper part of groove 34.

Thereafter the door 31 is permitted to drop until totally supported by the longitudinally extending ledges formed by bar members 22, 23. The combined door arrangement of coupled doors 30, 31, is then shifted laterally in the opposite direction into the groove 34 until the edge of door member 31 is seated in the groove 34 in abutting relation with the side wall 18, as shown in FIG. 4. At this position, the lockbolt 51 is in alignment with the notch 50 and the combination of lock 20 may be spun to lock the doors 30 and 31 in position.

With this configuration of a two door sliding safe structure, an efficient, yet simple arrangement is provided for secure locking. In the event an intruder attempts to pry the doors 30, 31 by placing a pry bar between the inner edges of either groove 32 or 34, the side forces exerted will place the lockbolt 51 in shear relative to the notch 50. The upper strap member 52 secured to door 30 conceals the junction of the two doors 31. The edge abutting relationship of the two beveled edges 52*a* and 56*a* of the upper surfaces of the doors 30 and 31 serve to deter attempts at intrusion with a pry bar or chisel. In the event an intruder succeeds in prying strap members 52 and 56, the second inner or lower strap member 53 serves as an additional deterrent to the insertion of a pry bar, with alignment and locking pins 54, 55, further assisting to deter entry.

Although not necessary, an auxiliary key locking assembly 21 is provided on door member 30. The locking assembly 21 to be described is more fully described in Applicant's copending cross-referenced patent application, which, by this reference is incorporated herein. The locking assembly 21 is key actuable at the exterior of door 30, and is positioned opposite the combination lock mechanism 20.

The key lock assembly 21 is an economical readily available lockset, known as a cam lock, which has been modified, as will be described. The assembly 21 includes a threaded barrel portion 21*a*, which is passed through an aperture in the door 30, with the barrel 21*a* being secured to the bottom or interior of door 30, such as by a nut threadably engaging the barrel portion 21*a*. A locking arm 60 is pivotally secured, such as by a screw, to the tumbler actuated piston within the barrel portion 21*a*, and is actuable between locked and unlocked positions with a spring member 61 configured and positioned for frictionally maintaining the locking arm 60 in one of the two positions. Secured to the end of locking arm 60, such as by welding, is a cylindrical bar segment, which serves as an anti-intrusion device, or blocking member 70.

FIG. 3 depicts the door 30 with the lock assembly 21 in its locked position, and FIG. 6 depicts the same view with the lock assembly 21 in its locked position, about ninety degrees from the unlocked position. The locking arm 60 pivots in a plane generally parallel to the plane of the undersurface of the door 30, with a fixed spacing therebetween. The height of the blocking member 70 is slightly less than this spacing (See also FIG. 4). As will become apparent, the locking arm 60 does not, in fact, serve a true locking function in the instant invention. It's primary function is to serve as a carrier for the blocking member 70, and to place the blocking member in the proper position to resist lateral prying of the door assembly 30, 31.

By reference to FIG. 4, the diameter or width of the blocking member 70 is such that, when positioned on the arm 60, and with the arm 60 in the locked position, the blocking member extends beyond the edge of the door 30 a distance generally equal to the gap formed to the right of the edge of door 30 with the second door 31 bottomed against the seat of groove 34 of opposing end wall 18.

Figure 5:
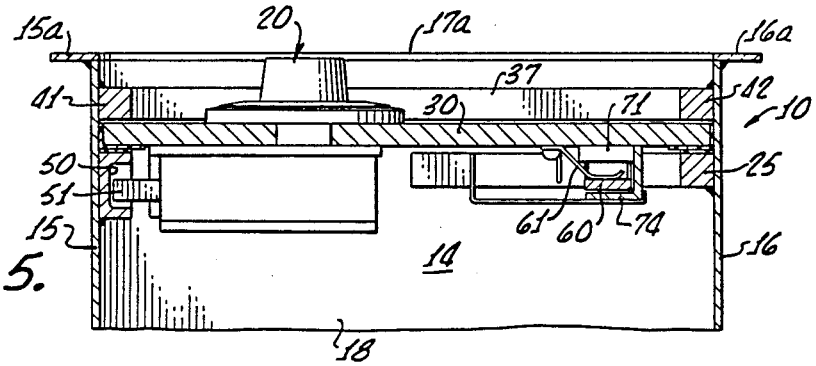
FIG. 5 is an end cross-sectional view of the door arrangement of the safe apparatus of FIG. 2, as viewed generally along line 4—4 thereof.

By reference to FIGS. 3–5, a short bar piece stop member 71 formed of steel is suitably secured to the undersurface of the door 30 at a position in alignment with the locking arm 60 in its locked position, the stop member 72 being located inwardly or rearwardly of the position of the blocking member 70 in the locked position of FIGS. 3 and 4. The stop member 72 is positioned for coaction with a side of the blocking member 70, with the other side of blocking member 70 in proximate or abutting relation with the bar 25 of the lower ledge to thereby assist in the deterrent effect in resisting lateral prying of the door assembly 30, 31.

To further thwart forced entry to the safe apparatus 10, a second anti-intrusion member 74, in the form of a short section of angle iron or steel is welded to the undersurface of the door 30, with a leg thereof extending in a plane parallel to, and slightly below, the plane of pivoting of the locking arm 60. As illustrated, the locking arm 60 is a metal strip or bar, with the plane of the bar lying in, and part of, the above referred to plane of pivoting of the locking arm 60. This plane is on close proximate relation to the plane of the lower leg of member 74. In the event someone attempts to use a punch on the lock assembly 21, the lower leg of member 74 limits the inward intrusion of the punched lock to thereby maintain the blocking member 70 in the locked position intermediate the bar 25 and the stop member 72.

In accordance with the safe construction hereinabove described, there is a simple, yet effective door and safe construction, which, in addition to the described embodiment, may be equally applicable to a cast in place safe of the type described in Applicant's U.S. Pat. No. 4,712,490.

By way of example, with the instant safe apparatus 10, the spacing between side walls 15 and 16 is about nine inches with the spacing between end walls 17 and 18 about twelve and three-eighth inches. The first door 30 is about five inches by nine inches with the second door 31 being about seven inches by nine inches. The doors 30 and 31 are formed of about three-eighths of an inch steel plate stock. The depth of the first groove 32 is about one-half inch with the depth of the second groove 34 being about one-quarter inch. The material used to form the upper and lower ledges 22–25 and 37, 41 and 42 is one-half inch bar stock while the bar member 38 is one-quarter by one half inch bar stock. In safe constructions, the combination lock 20 is a major contributor to weight. In accordance with the invention, in daily use, only the larger door 31 need be removed to provide access of about sixty percent of the total access opening. By placing the lock 20 on the smaller door 30, the weight of the larger door 31 may be minimized to facilitate its removal.

While there has been shown and described a preferred embodiment, it is to be understood that various other adaptations and modifications may be made within the spirit and scope of the invention. For example, although the door is depicted as being formed of two door members 30, 31 of generally uniform thickness, it is only necessary that the groove contacting edges be of a thickness consistent for being received within the appropriate groove. Furthermore, the lower ledges supporting the doors 30, 31 need not be continuous surfaces, but may be, for example, pins or rods projecting into the opening. Furthermore, it is to be understood that the directional terms herein employed are with reference to the structure as shown in the drawings and are not intended to be limiting. Other such variations will be readily apparent to those skilled in the art, and it is intended that the invention be limited only to the scope of the appended claims.

I claim:

1. In a safe apparatus, the combination comprising:

first and second pairs of opposing walls defining a generally rectangular chamber for receiving valuables therein through an access opening thereof;

first and second groove means on the opposite walls of said first pair of walls, with said second groove means having a depth at least twice the depth of said first groove means;

first and second separate doors for placement in edge abutting relation for substantially closing said access opening, the edge of each of said doors opposite the abutting edge having a thickness sufficient for being received within one of said first and second groove means, one of said doors having a dimension in the direction between said groove means of less than one-half the distance between the seats of said groove means, and the other of said doors having a dimension in the direction between said groove means generally equal to the distance between the seats of said first and second groove means less the dimension of said one door and less a predetermined dimension slightly greater than the depth of said first groove means;

first ledge means on opposing walls of said second pair of walls extending partially into said chamber in general alignment with said first and second groove means for enabling sliding relation with said first and second doors thereagainst in edge abutting relation;

second ledge means on the opposite walls of said second pair of walls in spaced relation to said first ledge means a distance sufficient for enabling slidable receipt of opposite edges of said one door therein, said second ledge means being dimensioned to have portions thereof overhanging said first door with said first door urged into contact with the seat of said first groove means;

said second door being inserted by positioning at an angle with a first edge thereof on said first ledge means and then sliding said first edge beneath the overhanging portions of said second ledge means while pivoting said second edge thereof toward said ledge means; and lock means for locking said first and second doors in edge abutting relation with the edge of said second door opposite said first edge in contact with the seat of said second groove means.

2. The safe apparatus according to claim 1 wherein said lock means includes a lock assembly on said one door and lockbolt receiving means in said first ledge means.

3. The safe apparatus according to claim 1 further including strap means on the outer surface of one of said doors for overlapping the junction of the abutting edges of said first and second doors.

4. The safe apparatus according to claim 1 further including means on the undersurface of one of said doors at the abutting edge thereof for coacting with the undersurface of the other door with both doors on said first ledge means for fixedly positioning one door relative to the other.

5. The safe apparatus according to claim 4 further including strap means on the outer surface of the other of said doors for overlapping the junction of the abutting edges of said first and second doors.

6. The safe apparatus according to claim 1 further including first strap means on the outer surface of one of said doors for overlapping and substantially concealing the junction of the abutting edges of said first and second doors, and second strap means on the undersurface of the other of said doors at the abutting edge thereof for coacting with the undersurface of the other door with both doors on said first ledge means for fixedly positioning one door relative to the other.

7. The safe apparatus according to claim 6 wherein said lock means includes a lock assembly with an actuable lockbolt on said one door and lockbolt receiving means in one of said first ledge means and said second pair of walls.

8. The combination according to claim 7 wherein said lockbolt receiving means is a notch in said first ledge means.

9. The safe apparatus according to claim 3 wherein said strap means is dimensioned to span the distance between said second ledge means.

10. The safe apparatus according to claim 1 wherein said first and second doors are generally plate-shaped steel of generally uniform thickness.

11. The safe apparatus according to claim 10 further including steel strap means on the outer surface of said first door for overlapping the junction of the abutting edges of said first and second doors, and steel strap means on the undersurface of said second door at the abutting edge thereof for coacting with the undersurface of said first door with both doors on said first ledge means for fixedly positioning one door relative to the other.

12. The safe apparatus according to claim 11 wherein said second strap means includes pin means extending in a direction generally perpendicular to said second strap means, and the adjacent undersurface of said first door includes aperture means for receiving said pin means with said second door in edge abutting relation with said first door and with both doors in abutment with said first edge means.

13. The safe apparatus according to claim 12 wherein said first strap means spans the distance between said second ledge means.

14. In a safe apparatus, the combination comprising:

first and second opposing wall means and third and fourth opposing wall means defining a generally rectangular chamber for receiving valuables therein through an access opening thereof;

first and second groove means on said third and fourth wall means, said second groove means having a depth at least twice the depth of said first groove means;

first and second separate door means for placement in edge abutting relation for substantially closing said access opening, (a) said first door means including first and second opposing edge portions, at least said first edge portion having a thickness sufficient for being received within said first groove means and having a first dimension generally equal to the spacing between said first and second wall means, and a second dimension in the direction between said groove means of less than one-half the distance between the seats of said groove means;

(b) said second door means including first and second opposing edge portions, at least said second edge portion having a thickness sufficient for being received within said second groove means and having a first dimension generally equal to the spacing between said first and second wall means, and a second dimension in the direction between said groove means, which dimension is generally equal to (i) the dimension between the seats of said first and second groove means;

(ii) less the second dimension of said first door;

(iii) less a predetermined dimension slightly greater than the depth of said first groove means;

first ledge means on said first and second wall means extending partially into said chamber, said first ledge means being in general alignment with said first and second groove means for enabling sliding relation with said first and second door means thereagainst in edge abutting relation;

second ledge means on said first and second wall means in spaced relation to said first ledge means, the spacing between said first and second ledge means being of a dimension for enabling slidable receipt of opposing edges of said first door means therein, the extent of said second ledge means in the direction between said third and fourth wall means being a dimension slightly greater than the second dimension of said first door means with portions of said second ledge means overhanging said first door means with said first door means urged into contact with the seat of said first groove means;

said second door means being inserted by positioning at an angle with said first edge thereof on said ledge means and then sliding said edge beneath the overhanging portions of said second ledge means while pivoting said second edge thereof toward said ledge means; and lock means on one of said door means for locking said door means in edge abutting relation while against said first ledge means, said lock means being actuable only when the second edge of said second door means is in contact with the seat of said second groove means with the second edge of said first door means in edge abutting relation with the first edge of said second door means.

15. The safe apparatus according to claim 14 wherein one of said first and second wall means includes lockbolt receiving means and said lock means are on said first door means, said lock means including a lockbolt actuable from a first unlocked position into a second locked position in engagement with said lockbolt receiving means.

16. The safe apparatus according to claim 15 wherein said lockbolt receiving means is a notch in said first ledge means.

17. The safe apparatus according to claim 14 wherein said lock means is on said first door means.

18. The safe apparatus according to claim 14 further including strap means on the outer surface of one of said first and second door means for overlapping the junction of the abutting edges of said first and second door means.

19. The safe apparatus according to claim 14 further including means on the undersurface of one of said door means at the abutting edge thereof for coacting with the undersurface of the other of said door means with both door means on said first ledge means for fixedly positioning one door means relative to the other.

20. The safe apparatus according to claim 18 further including strap means on the outer surface of the other of said door means for overlapping the junction of the abutting edges of said first and second door means on the undersurface thereof.

21. The safe apparatus according to claim 14 further including first strap means on the outer surface of one of said first and second door means for overlapping and substantially concealing the exterior junction of the abutting edges of said first and second door means, and second strap means on the undersurface of the other of said first and second door means at the abutting edge thereof for coacting with the undersurface of the other door means with both door means on said first ledge means for fixedly positioning one door relative to the other.

22. In a door closure arrangement for a safe having first and second opposing side walls and third and fourth opposing end walls defining a chamber having an access opening for receiving valuables therein, the combination comprising:

first and second groove means on said third and fourth wall means, said second groove means having a depth at least twice the depth of said first groove means;

first and second separate door means for placement in edge abutting relation for substantially closing said access opening, (a) said first door means including first and second opposing edge portions, at least said first edge portion having a thickness sufficient for being received within said first groove means and having a first dimension generally equal to the spacing between said first and second wall means, and a second dimension in the direction between said groove means of less than one-half the distance between the seats of said groove means;

(b) said second door means including first and second opposing edge portions, at least said second edge portion having a thickness sufficient for being received within said second groove means and having a first dimension generally equal to the spacing between said first and second wall means, and a second dimension in the direction between said groove means, which dimension is generally equal to (i) the dimension between the seats of said first and second groove means;

(ii) less the second dimension of said first door;

(iii) less a predetermined dimension slightly greater than the depth of said first groove means;

first ledge means on said first and second wall means extending partially into said chamber, said first ledge means being in general alignment with said first and second groove means for enabling sliding relation with said first and second door means thereagainst in edge abutting relation;

second ledge means on said first and second wall means in spaced relation to said first ledge means, the spacing between said first and second ledge means being of a dimension for enabling slidable receipt of opposing edges of said first door means therein, the extent of said second ledge means in the direction between said third and fourth wall means being a dimension slightly greater than the second dimension of said first door means with portions of said second ledge means overhanging said first door means with said first door means urged into contact with the seat of said first groove means;

said second door means being inserted by positioning at an angle with said first edge thereof on said ledge means and then sliding said edge beneath the overhanging portions of said second ledge means while pivoting said second edge thereof toward said ledge means; and lock means on one of said door means for locking said door means in edge abutting relation while against said first ledge means, said lock means being actuable only when the second edge of said second door means is in contact with the seat of said second groove means with the second edge of said first door means in edge abutting relation with the first edge of said second door means.

23. The door closure arrangement according to claim 22 wherein said lock means is on said first door means.

24. The door closure arrangement according to claim 22 further including strap means on the outer surface of one of said first and second door means for overlapping the junction of the abutting edges of said first and second door means.

25. The door closure arrangement according to claim 22 further including means on the undersurface of one of said door means at the abutting edge thereof for coacting with the undersurface of the other of said door means with both door means on said first ledge means for fixedly positioning one door means relative to the other.

26. The door closure arrangement according to claim 24 further including strap means on the outer surface of the other of said door means for overlapping the junction of the abutting edges of said first and second door means on the undersurface thereof.

27. The door closure arrangement according to claim 22 further including first strap means on the outer surface of said first door means for overlapping and substantially concealing the exterior junction of the abutting edges of said first and second door means, and second strap means on the undersurface of said second door means at the abutting edge thereof for coacting with the adjacent undersurface of said first door means with both door means on said first ledge means for fixedly positioning one door relative to the other.

28. A method for closing a safe having first and second pairs of opposing walls defining a generally rectangular chamber for receiving valuables therein through an access opening thereof, the method comprising:

providing first and second groove means on the opposite walls of said first pair of walls, with said second groove means having a depth at least twice the depth of said first groove means;

providing first ledge means on opposing walls of said second pair of walls extending partially into said chamber in general alignment with said first and second groove means;

providing second ledge means on the opposing walls of said second pair of walls in uniformly spaced relation to said first ledge means, said second ledge means having a dimension of less than half the distance between said groove means and being adjacent said second groove means;

positioning a first generally rectangular door with the lateral edges thereof on said first ledge means, said first door having a dimension transverse to the lateral edges which is less than the dimension of said second ledge means;

sliding said first door into the space between said first and second ledge means and into contact with the seat of said second groove means with said second ledge means projecting beyond the dimension of said first door;

positioning a second generally rectangular door at an angle with a first edge thereof on said first ledge means and then sliding said first edge beneath the projecting portions of said second ledge means while pivoting said second edge thereof toward said ledge means, the combined dimension of said first and second doors in the direction between said groove means being generally equal to the distance between the seats of said first and second groove means less a predetermined dimension slightly greater than the depth of said first groove means;

sliding both doors in the opposite direction until said second door has an edge thereof in contact with the seat of said first groove means whereby said first and second doors substantially close said access opening; and locking said first door relative to the walls of said chamber.

29. The method according to claim 28 further including fixing the relationship of said first and second doors relative to one another with both doors on said first ledge means.

30. In a door closure arrangement for a safe having first and second opposing side walls and third and fourth opposing end walls defining a chamber having an access opening of a given area for receiving valuables therein, the combination comprising:

first and second separate steel door for placement in edge abutting relation for substantially closing said access opening;

means on at least some of said walls for retaining said doors in fixed relation to said access opening; and strap means secured to the outer surface of at least one of said doors for substantially concealing the junction of the abutting edges of said first and second doors for deterring access to said junction by an intruder, said strap means including a first generally bar-shaped steel strap member secured to one of said doors in overlapping relation to the edge thereof, with the overlapping portion in close abutting relation with the outer surface of the other door at the edge thereof.

31. The door closure arrangement according to claim 30 wherein said strap means includes a second steel strap member secured to the outer surface of the other door member adjacent the edge thereof at a position for edge abutting relation with the first strap member with said doors in edge abutting relation.

32. In a door closure arrangement for a safe having first and second opposing side walls and third and fourth opposing end walls defining a chamber having an access opening of a given area for receiving valuables therein, the combination comprising:

first and second substantially inflexible separate steel doors for placement in edge abutting relation for substantially closing said access opening;

means on at least some of said walls for retaining said doors in fixed relation to said access opening;

strap means secured to the outer surface of at least one of said doors for substantially concealing the junction of the abutting edges of said first and second doors for deterring access to said junction by an intruder, said first strap means including a first steel strap member secured to one of said doors in overlapping relation to the edge thereof, with the overlapping portion in close abutting relation with the outer surface of the other door at the edge thereof, said strap means further including a second steel strap member secured to the outer surface of the other door member adjacent the edge thereof at a position for edge abutting relation with the first strap member with said doors in edge abutting relation, and wherein said first and second strap members are beveled at the abutting edges thereof to form a generally V-shaped groove, said beveled edges serving to deter use of a pry bar to separate said doors.

33. The door closure arrangement according to claim 32 wherein said first and second strap members include bevel means along the non-abutting edges for deterring use of a sharp object to pry said strap members from the outer surface of said doors.

34. The door closure arrangement according to claim 33 wherein said bevel means are formed, at least in part, by a weld bead securing said strap members to said doors.

35. In a door closure arrangement for a safe having first and second opposing side walls and third and fourth opposing end walls defining a chamber having an access opening of a given area for receiving valuables therein, the combination comprising:

first and second separate steel doors for placement in edge abutting relation for substantially closing said access opening;

means on at least some of said walls for retaining said doors in fixed relation to said access opening;

strap means secured to the outer surface of at least one of said doors for substantially concealing the junction of the abutting edges of said first and second doors for deterring access to said junction by an intruder; and strap means on the undersurface of the other of said doors for overlapping the junction of the abutting edges of said first and second doors on the undersurface thereof.

36. The door closure arrangement according to claim 35 further including means on the undersurface of the said one of said doors at the abutting edge thereof, and mating means on said strap means of said other door for coaction with said doors in edge abutting relation for fixedly positioning one door relative to the other.

* * * * *